US007152929B2

(12) United States Patent
Wu

(10) Patent No.: US 7,152,929 B2
(45) Date of Patent: Dec. 26, 2006

(54) STRUCTURE OF A DOUBLE-MESH SEAT OF A CHAIR

(75) Inventor: Yu-Ling Wu, Tainan hsien (TW)

(73) Assignee: Comfordy Co., Ltd., Tainan Hsien (TW)

( * ) Notice: Subject to any disclaimer, the term of this patent is extended or adjusted under 35 U.S.C. 154(b) by 0 days.

(21) Appl. No.: 11/109,847

(22) Filed: Apr. 20, 2005

(65) Prior Publication Data

US 2006/0250019 A1 Nov. 9, 2006

(51) Int. Cl.
*A47C 7/02* (2006.01)

(52) U.S. Cl. ..... 297/452.56; 297/452.22; 297/452.46

(58) Field of Classification Search ..... 297/452.21, 297/452.22, 452.46, 452.47, 452.55, 452.56, 297/452.65, 218.3, 218.5, 284.2
See application file for complete search history.

(56) References Cited

U.S. PATENT DOCUMENTS 2,286,171 A * 6/1942 Krasnov et al. ..... 297/224
5,013,089 A * 5/1991 Abu-Isa et al. ..... 297/452.64
5,393,126 A * 2/1995 Boulva ..... 297/452.56
6,035,901 A * 3/2000 Stumpf et al. ..... 139/419
6,152,534 A * 11/2000 Maeda et al. ..... 297/452.56
6,231,125 B1 * 5/2001 Maeda et al. ..... 297/452.56
6,406,093 B1 * 6/2002 Miotto et al. ..... 297/218.5
6,942,300 B1 * 9/2005 Numa et al. ..... 297/452.56
2006/0152061 A1 * 7/2006 Wu ..... 297/452.21

* cited by examiner

*Primary Examiner*—Rodney B. White
*Assistant Examiner*—Joseph Edell
(74) *Attorney, Agent, or Firm*—Rosenberg, Klein & Lee

(57) ABSTRACT

A chair seat includes a lower loop-shaped member, an auxiliary mesh, a loop-shaped pad part, and an upper mesh; the lower loop-shaped member encircles a first space; the auxiliary mesh is positioned over the first space and the lower loop-shaped member, and securely connected to the lower loop-shaped member at an edge; the loop-shaped pad part encircles a second space, and is secured over the lower loop-shaped member with the second space being right above the first space; the upper mesh is positioned over the second space and the loop-shaped pad part, and securely joined to a lower side of the lower loop-shaped member at an edge; the seat is positioned on top of and joined to a loop-shaped portion of a main unit of a chair at the lower loop-shaped member thereof so that the auxiliary mesh will help the upper mesh bear the sitter's body weight.

3 Claims, 6 Drawing Sheets

STRUCTURE OF A DOUBLE-MESH SEAT OF A CHAIR

BACKGROUND OF THE INVENTION

1. Field of the Invention

The present invention relates to a mesh seat of a chair, more particularly one, which is structured in such a way as to have more strength and be more comfortable to sit on.

2. Brief Description of the Prior Art

A chair seat should be soft to be comfortable to sit on according to most people. Referring to FIG. 5, a conventional chair seat 3 includes a foam member 31, a lower plate 32, and a covering cloth 33. The foam member 31 is positioned over the lower plate 32, and both the foam member 31 and the lower plate 32 are wrapped in the covering cloth 33. The seat 3 is joined to a main unit 4 of a chair; thus, the chair has a soft seat. However, because air can't easily travel through foam, heat will accumulate at the seat 3, and the sitter will feel hot and uncomfortable at the buttock after having been seated on the chair for a period of time.

To overcome the above problem, another conventional chair seat 5 is provided as shown in FIG. 6, which includes a loop-shaped part 51, and a mesh 52. The mesh 52 is stretched to have a certain tension, and securely joined to the loop-shaped part 51 at an edge thereof so as to cover a space encircled by the loop-shaped part 51; thus, air can easily 1. travel through the seat 5. And, the seat 5 is positioned on and securely joined to a main unit 6 of a chair.

However, the conventional mesh seat still has the following disadvantages:

1. The loop-shaped part has certain hardness such that the mesh, which is stretched to have certain tension, won't cause the loop-shaped part to change shape. Consequently, when a person is seated on the seat, he/she will feel discomfort owing to contact with the loop-shaped part.

2. Because the seat has single mesh with limited strength, the mesh will change shape after having been used for a period of time, and it is prone to break if a heavy person is seated on the seat.

SUMMARY OF THE INVENTION

It is a main object of the invention to provide a double-mesh seat of a chair to overcome the above-mentioned problems.

The double-mesh seat of the present invention includes a lower loop-shaped member, an auxiliary mesh, a loop-shaped pad part, and an upper mesh. The lower loop-shaped member encircles a first space. The auxiliary mesh is positioned over the first space and the lower loop-shaped member, and securely connected to the lower loop-shaped member at the edge. The loop-shaped pad part encircles a second space, and is secured over the lower loop-shaped member with the second space being right above the first space. The upper mesh is positioned over the second space and the loop-shaped pad part, and securely joined to a lower side of the lower loop-shaped member. The seat is positioned on top of and joined to a loop-shaped portion of a main unit of the chair at the lower loop-shaped member. Thus, the auxiliary mesh will help the upper mesh bear the sitter's body weight.

DETAILED DESCRIPTION OF THE PREFERRED EMBODIMENTS

Figure 1:
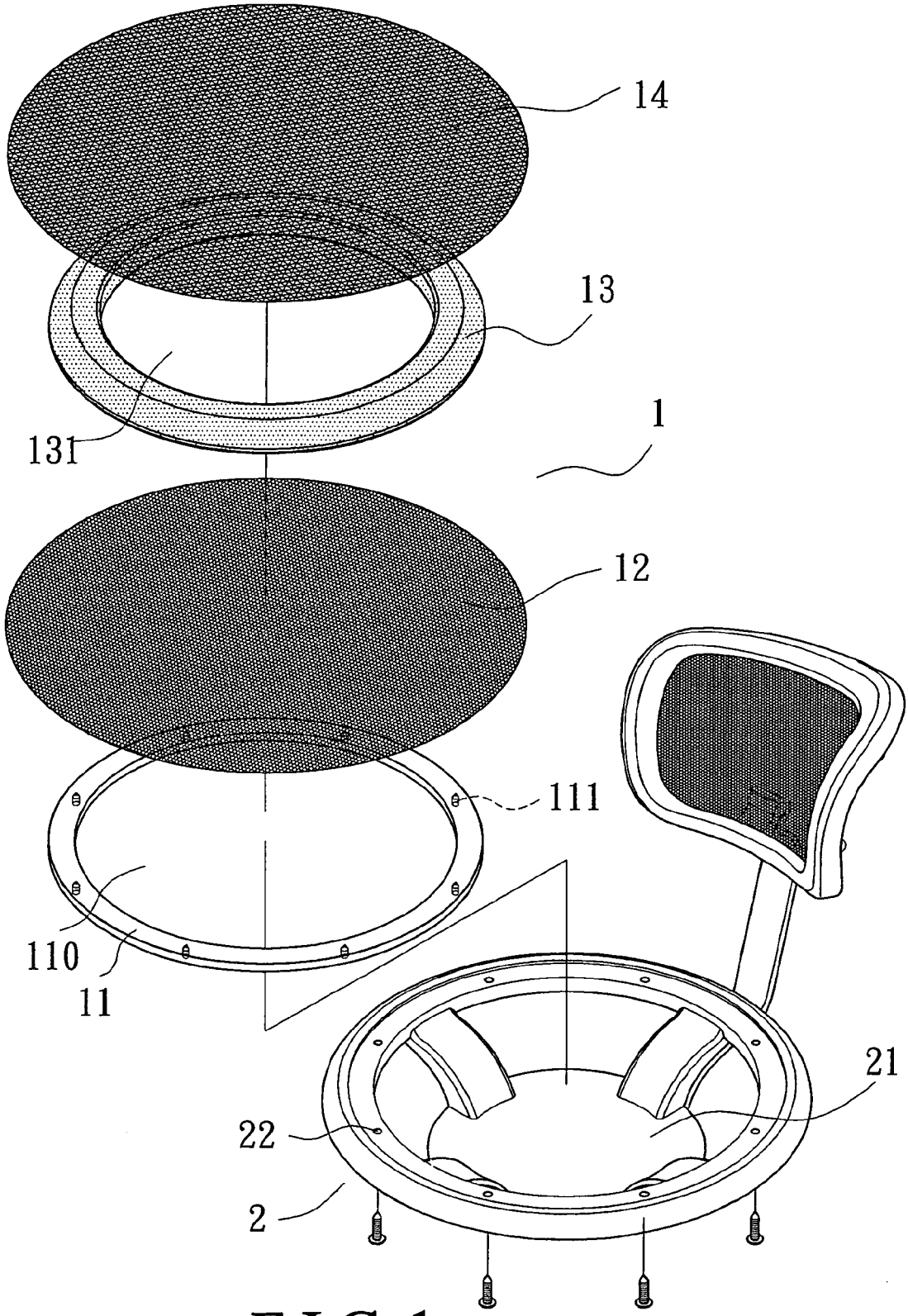
FIG. 1 is an exploded perspective view of the double-mesh seat and the main part of a chair according to the present invention.
Figure 2:
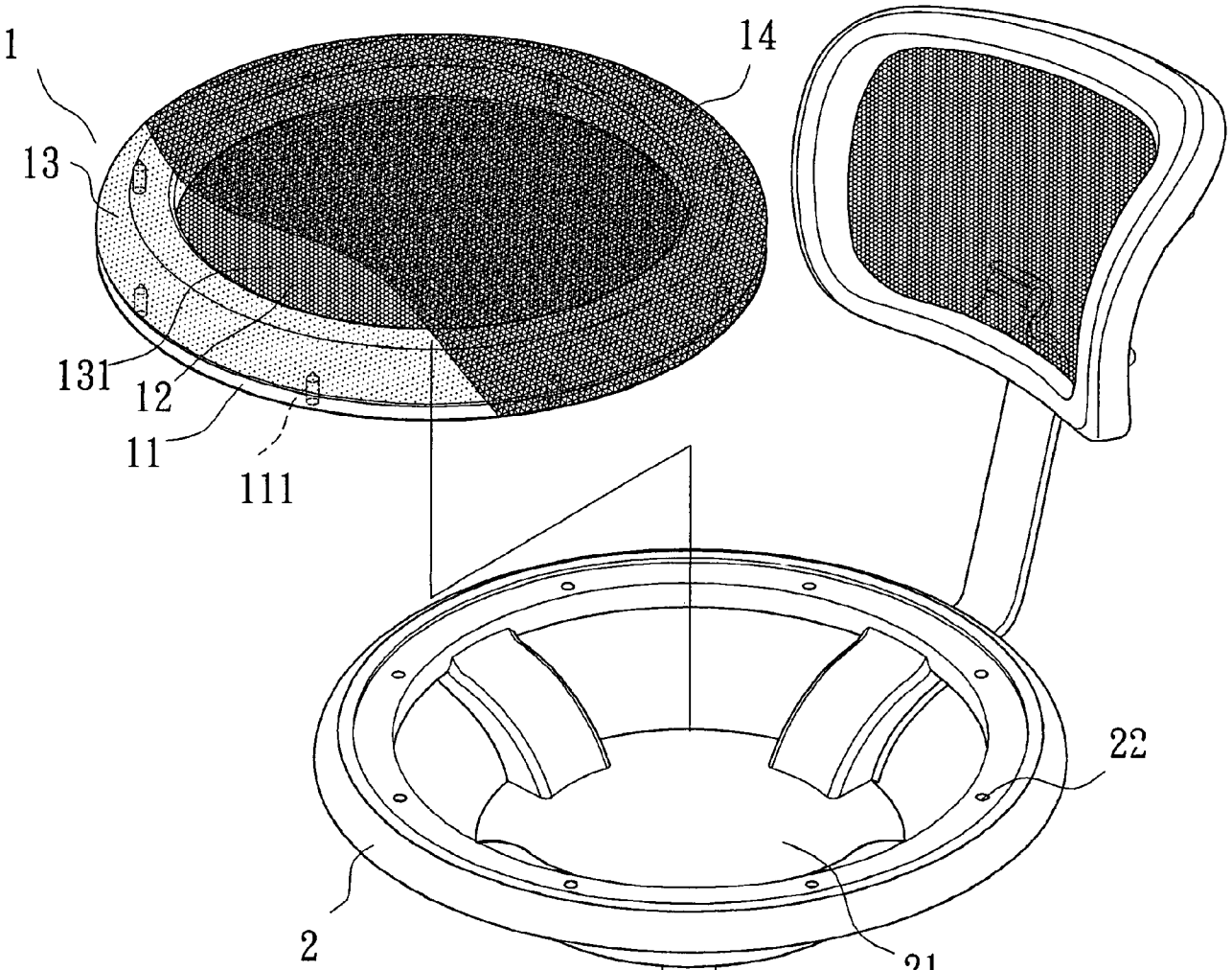
FIG. 2 is a perspective view of the double-mesh seat and the main part in the present invention.
Figure 3:
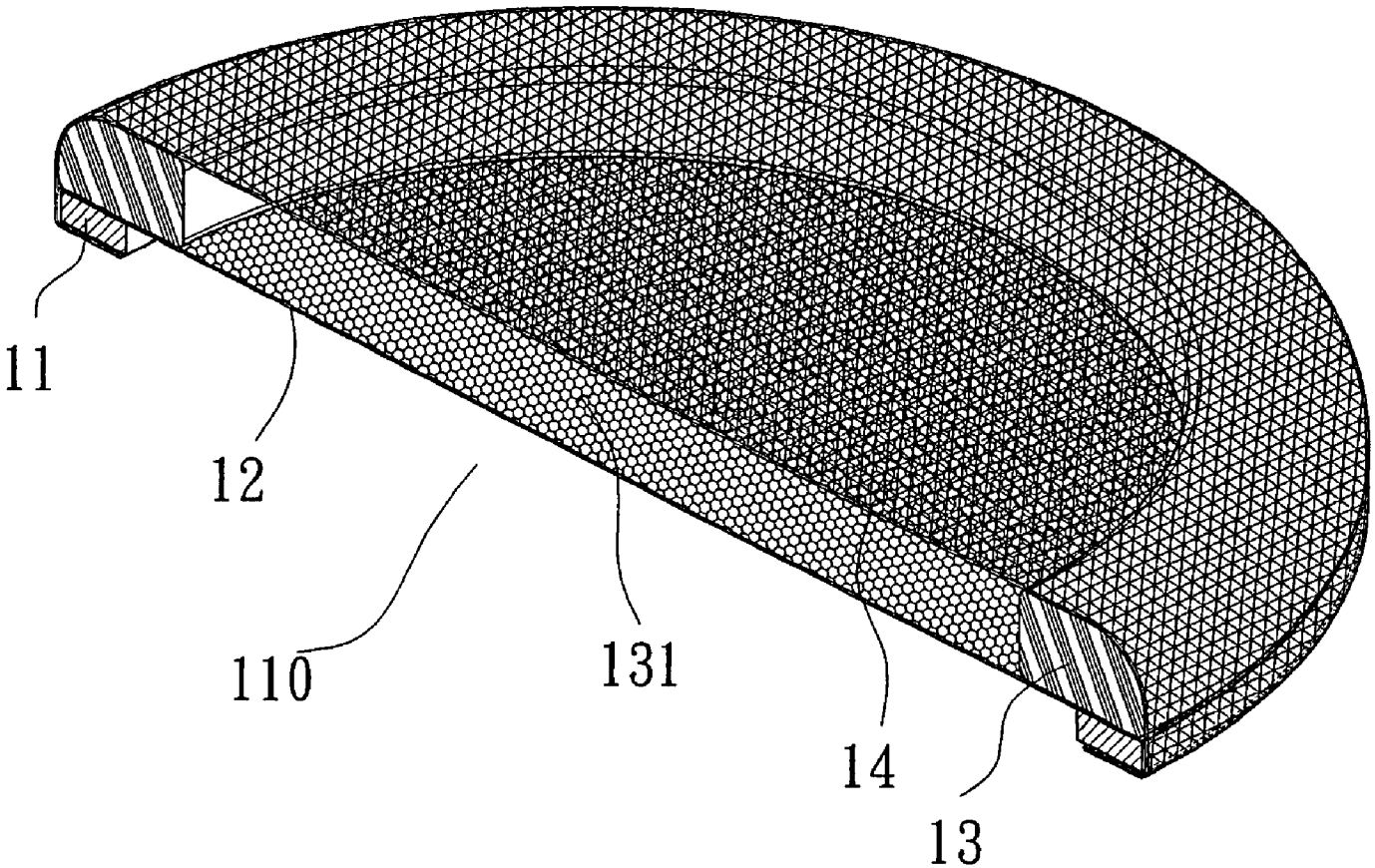
FIG. 3 is a sectional view of the double-mesh seat of the invention.
Figure 4:
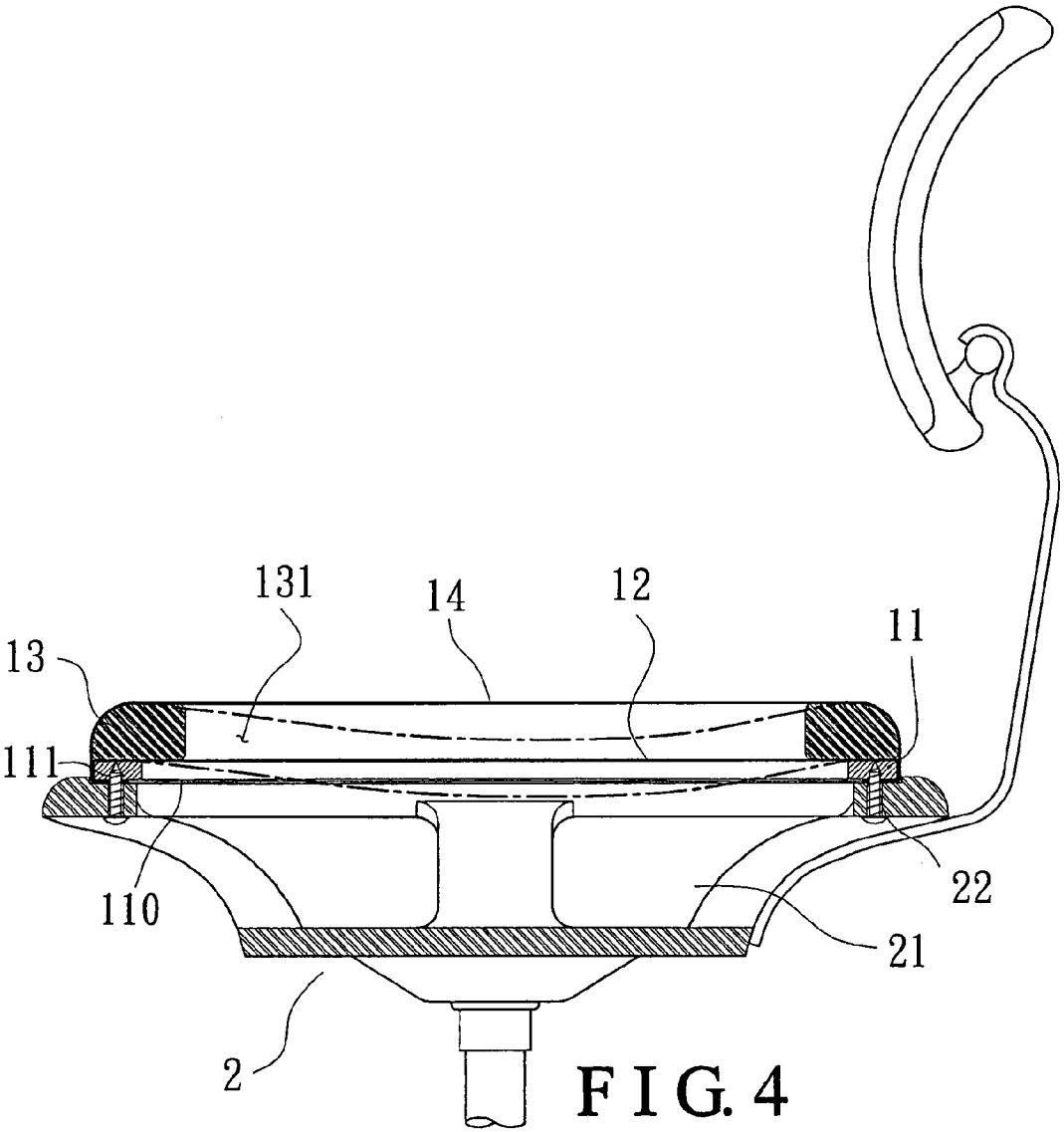
FIG. 4 is a partial sectional view of the chair according to the present invention.
Figure 5:
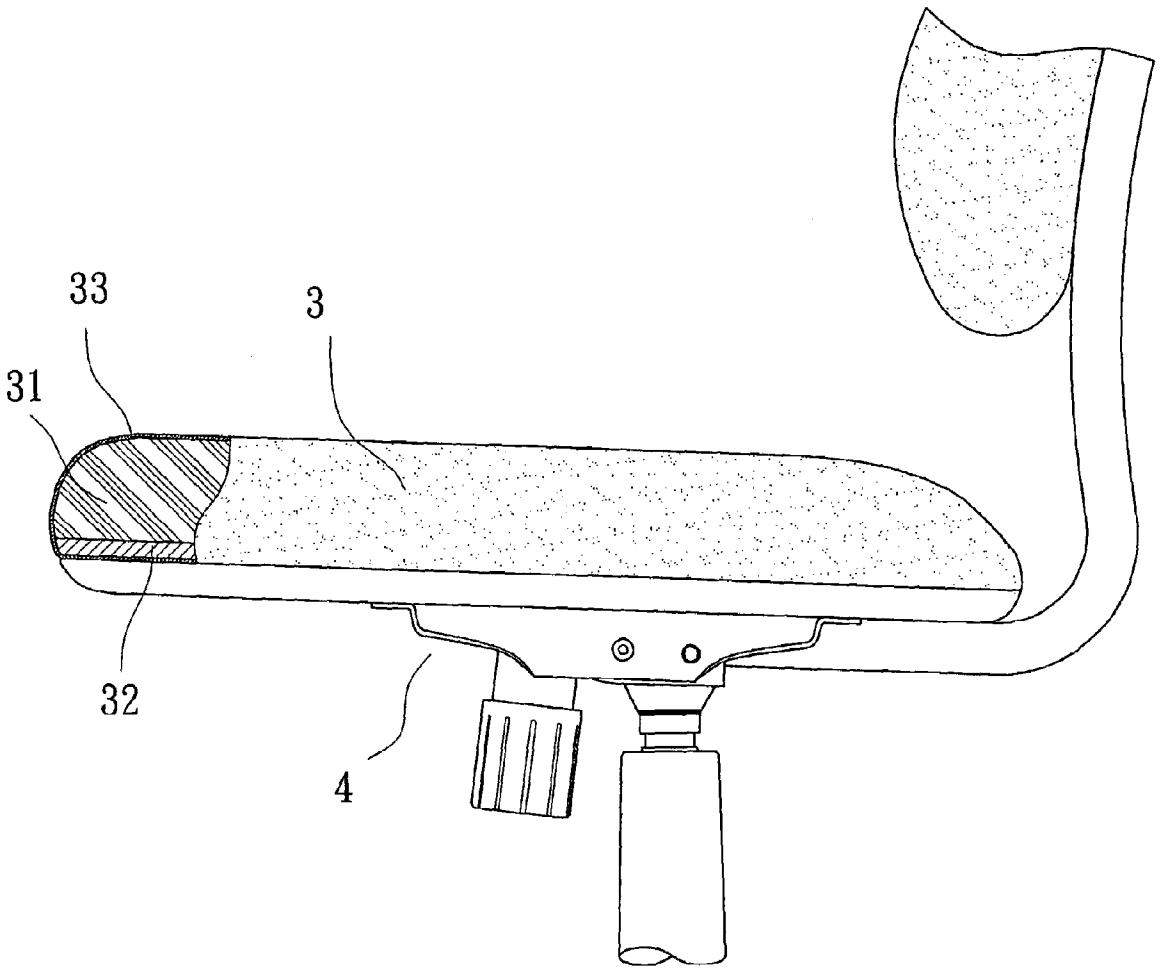
FIG. 5 (PRIOR ART)
FIG. 5 is a view of the first conventional chair seat.
Figure 6:
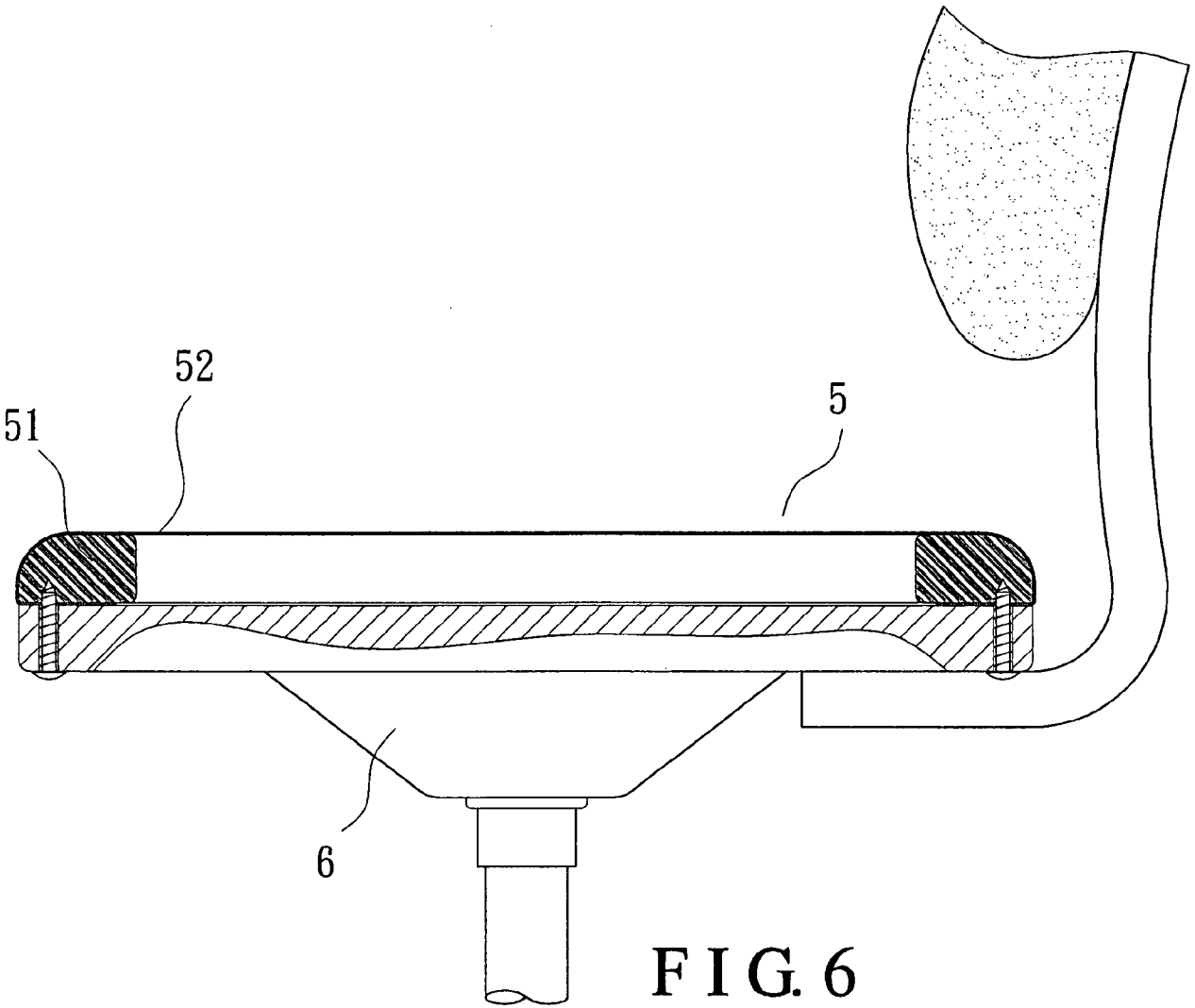
FIG. 6 (PRIOR ART)
FIG. 6 is a view of the second conventional chair seat.

Referring to FIG. 1, a preferred embodiment 1 of a double-mesh seat of a chair includes a lower loop-shaped member 11, an auxiliary mesh 12, a loop-shaped pad part 13, and an upper mesh 14.

The lower loop-shaped member 11 encircles a space 110, and has several connecting holes 111 on a lower side thereof.

The auxiliary mesh 12 is positioned over the space 110 and the lower loop-shaped member 11, and securely connected to a lower side of the lower loop-shaped member 11 at an edge thereof.

The loop-shaped pad part 13 is made of soft materials such as foam to be comfortable to sit on, and it encircles a space 131. The loop-shaped pad part 13 is positioned over the lower loop-shaped member 11 with the space 131 being right above the space 110.

The upper mesh 14 is positioned over the space 131 and the loop-shaped pad part 13, and securely joined to a lower side of the lower loop-shaped member 11 at an edge thereof.

Referring to FIGS. 1 to 4, the double-mesh seat 1 is securely joined to a main unit 2 of the chair after it is assembled, which main unit 2 has a loop-shaped portion, which encircles a space 21, and has several connecting holes 22; the double-mesh seat 1 is positioned over the space 21 and the loop-shaped portion of the main unit 2, and screws are passed through the connecting holes 22 of the main unit 2 and into the connecting holes 111 of the lower loop-shaped member 11.

Thus, a space is provided under the double-mesh seat for receiving the buttock of a sitter, which is encircled by the double-mesh seat 1 and the main unit 2. And, if a heavy person is seated on the chair, the auxiliary mesh 12 will help the upper mesh 14 bear the body weight of the sitter.

From the above description, it can be easily seen that the present invention has the following advantages when compared with the conventional seats described in Background:

1. The double-mesh seat has a loop-shaped pad part 13 on top of the lower loop-shaped member 11 therefore it is more comfortable to sit on.

2. The double-mesh seat has the auxiliary mesh to help the upper mesh bear the weight of the sitter. Therefore, the upper mesh will have longer service life.

3. Air can travel through the seat easily because the seat has the upper mesh and the auxiliary mesh secured over the space encircled by the loop-shaped parts.

What is claimed is:

1. A double-mesh seat of a chair, comprising a lower annular member, the lower annular member encircling a first space;

an auxiliary mesh, the auxiliary mesh being positioned over the first space and the lower annular member, and securely connected to a lower side of the lower annular member adjacent an edge thereof;

an annular pad part, the annular pad part encircling a second space, the annular pad part being disposed on the auxiliary mesh and positioned over the lower annular member with the second space being right above the first space;

an upper mesh, the upper mesh being positioned over the second space and the annular pad part, and securely joined to the lower side of the lower annular member adjacent an edge thereof and thereby securing the annular pad part, the upper mesh overlaying the auxiliary mesh on the lower side of the lower annular member and being spaced from the auxiliary mesh over the second space by the annular pad part;

a main unit of the chair having the seat secured thereon, the main unit having an annular portion, the annular portion encircling a third space; and a funnel shaped envelope defined by a plurality of supports extending from said annular portion, said funnel shaped envelope defining a cavity located below said third space.

2. The double-mesh seat of a chair as claimed in claim 1, wherein annular pad part is made of foam to resiliently space the upper mesh from the auxiliary mesh.

3. The double-mesh seat of a chair as claimed in claim 1, wherein the lower annular member has a plurality of connecting holes on a lower side thereof, and the annular portion of the main unit having a plurality of connecting holes; the lower annular member being securely joined to the annular portion of the main unit with the connecting holes thereof being aligned with respective ones of the connecting holes of the main unit, and with the first space encircled by the lower annular member being right above the third space of the main unit.

* * * * *